US006676231B1

(12) United States Patent
Kelley et al.

(10) Patent No.: US 6,676,231 B1
(45) Date of Patent: Jan. 13, 2004

(54) MODULAR FURNITURE SYSTEM

(75) Inventors: James O. Kelley, Spring Lake, MI (US); Ralph J. Byma, Zeeland, MI (US); Gregg J. Persons, Wyoming, MI (US); Errol S. Pearsons, Grand Haven, MI (US)

(73) Assignee: Sligh Furniture Co., Holland, MI (US)

( * ) Notice: Subject to any disclaimer, the term of this patent is extended or adjusted under 35 U.S.C. 154(b) by 0 days.

(21) Appl. No.: 08/840,960

(22) Filed: Apr. 17, 1997

(51) Int. Cl.[7] ..... A47B 77/00
(52) U.S. Cl. ..... 312/107; 312/203; 108/50.01
(58) Field of Search ..... 312/195, 196, 312/198, 107, 203, 108; 108/50.01, 50.02

(56) References Cited

U.S. PATENT DOCUMENTS

| | | | | | |
|---|---|---|---|---|---|
| 4,536,044 | A | * | 8/1985 | Ziegelheim et al. | 312/196 X |
| 4,914,873 | A | * | 4/1990 | Newhouse | 312/192 X |
| 5,024,167 | A | * | 6/1991 | Hayward | 312/195 X |
| 5,103,741 | A | * | 4/1992 | Grund et al. | 312/196 X |
| 5,130,494 | A | * | 7/1992 | Simonton et al. | 312/195 X |
| 5,163,536 | A | * | 11/1992 | Tuhro et al. | 312/198 X |
| 5,255,966 | A | * | 10/1993 | Newhouse et al. | 312/195 X |
| 5,346,296 | A | * | 9/1994 | Kelley | 312/198 |
| 5,382,088 | A | * | 1/1995 | Young | 312/265.5 X |
| 5,536,078 | A | * | 7/1996 | Novikoff | 312/195 |

FOREIGN PATENT DOCUMENTS

| | | | | |
|---|---|---|---|---|
| DE | 1046282 | * | 12/1958 | 312/198 |
| DE | 2241048 | * | 3/1974 | 312/265.5 |
| FR | 385333 | * | 5/1908 | 312/265.5 |
| JP | 405137618 | * | 5/1908 | 312/265.5 |

* cited by examiner

*Primary Examiner*—Lanna Mai
*Assistant Examiner*—Hanh V. Tran
(74) *Attorney, Agent, or Firm*—Waters & Morse, P.C.

(57) ABSTRACT

A modular furniture system has a number of variously configured work surfaces, a number of variously configured support members, variously configured hutch units, and a number of couplers. At least two support members and a work surface are arranged and coupled together to construct a work station. The work surfaces have at least three sides with at least two of the sides being adapted to releasably couple with one of the support members. The support members may include leg supports and storage cabinet supports, each of which are adapted to couple with and support a work surface above a floor. The hutches are adapted to removably rest upon a work surface or a storage cabinet support member. Further, the hutches, the work surfaces, and the support members may be provided with cable passages to facilitate use of electronic equipment at a work station.

1 Claim, 17 Drawing Sheets

MODULAR FURNITURE SYSTEM

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

The invention relates to work station systems, and the like, that are used in an office or home.

Panel based, office partition and work station systems are well known and available from numerous manufacturers. Panel based systems build from a vertical partition panel to provide various work surface, storage, and space defining functions, for example. The foundation of panel partition systems is, inherently, the vertical partition panel. The storage and work surface components typically cantilever from the vertical partition panel and are not useful without the primary building element of the system, namely, the panel.

Panel based systems are not compatible with every work environment, however. The panel, which is the basic building element of panel based systems, is simply out of place in many settings. For example, using a panel based office system in a traditional setting that has conventional office spaces that are defined as rooms by walls, presents an impression of indecisive, make-shift, low budget, or unprofessional work. Additionally, more and more workers are able to perform their work tasks from home. The inherently commercial styling of office partition panel systems commonly clashes with or is otherwise out of place in typical home settings, even in home offices.

Thus, one will appreciate the need for a modular space organization and work station system with a variety of work surface and storage options, for example, that is structured to fit into conventional or traditional environments.

BRIEF SUMMARY OF THE INVENTION

Accordingly, a modular furniture system according to the invention includes a number of variously configured work surfaces, a number of variously configured support members, a number of couplers to releasably couple the work surfaces and support members, and variously configured desk top hutches. In one aspect of the invention, the support members may be configured as legs or storage cabinets. In another aspect of the invention, each work surface has at least three sides with at least two of the sides being ends that are adapted for releasable coupling with a support member. In one embodiment, the coupler has a body with a head and a threaded leg that extends away from the head to a terminal end, and has a cooperating nut with a head and a threaded shaft that extends away from the head to a terminal end. In yet another aspect of the invention, cabling passages are provided in the work surfaces, support members and hutches, to facilitate use of electronic equipment.

These and other features, objects, and benefits of the invention will be recognized by one having ordinary skill in the art and by those who practice the invention, from the specification, the claims, and the drawing figures.

DETAILED DESCRIPTION OF THE INVENTION

Figure 1:
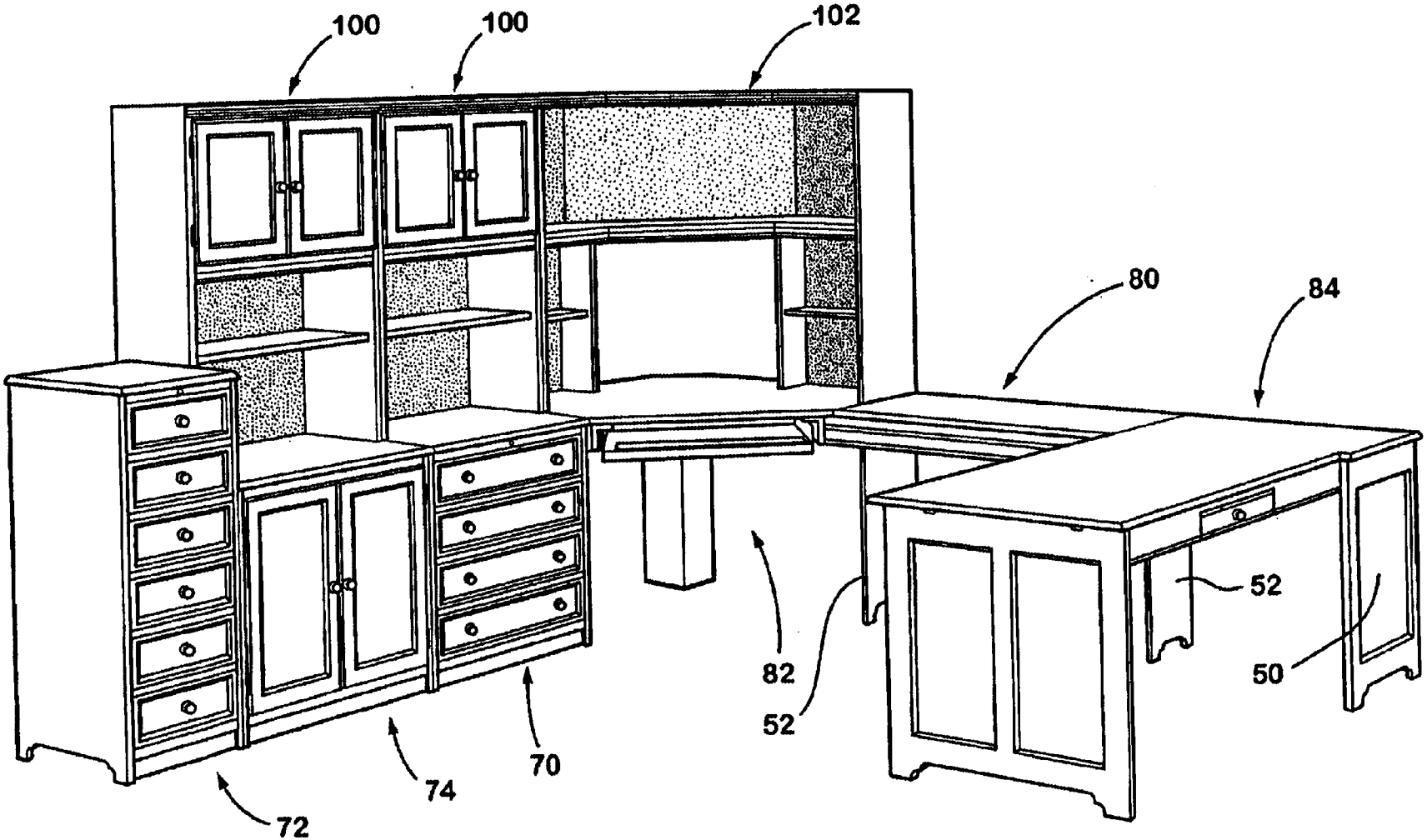
FIG. 1 is a front perspective view of a first arrangement of components of a modular furniture system according to the invention.
Figure 2:
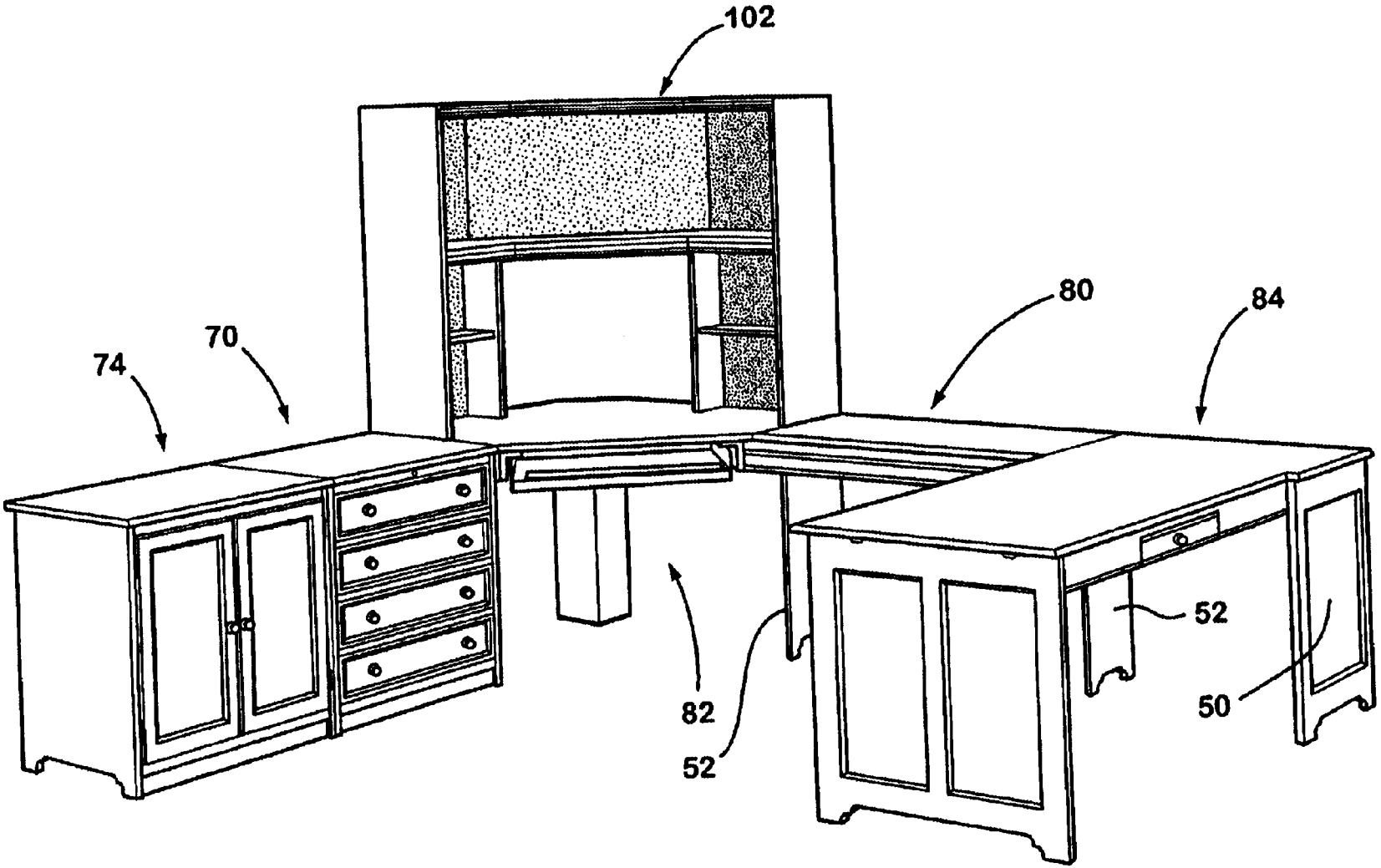
FIG. 2 is a front perspective view of a second arrangement of components of the system.
Figure 3:
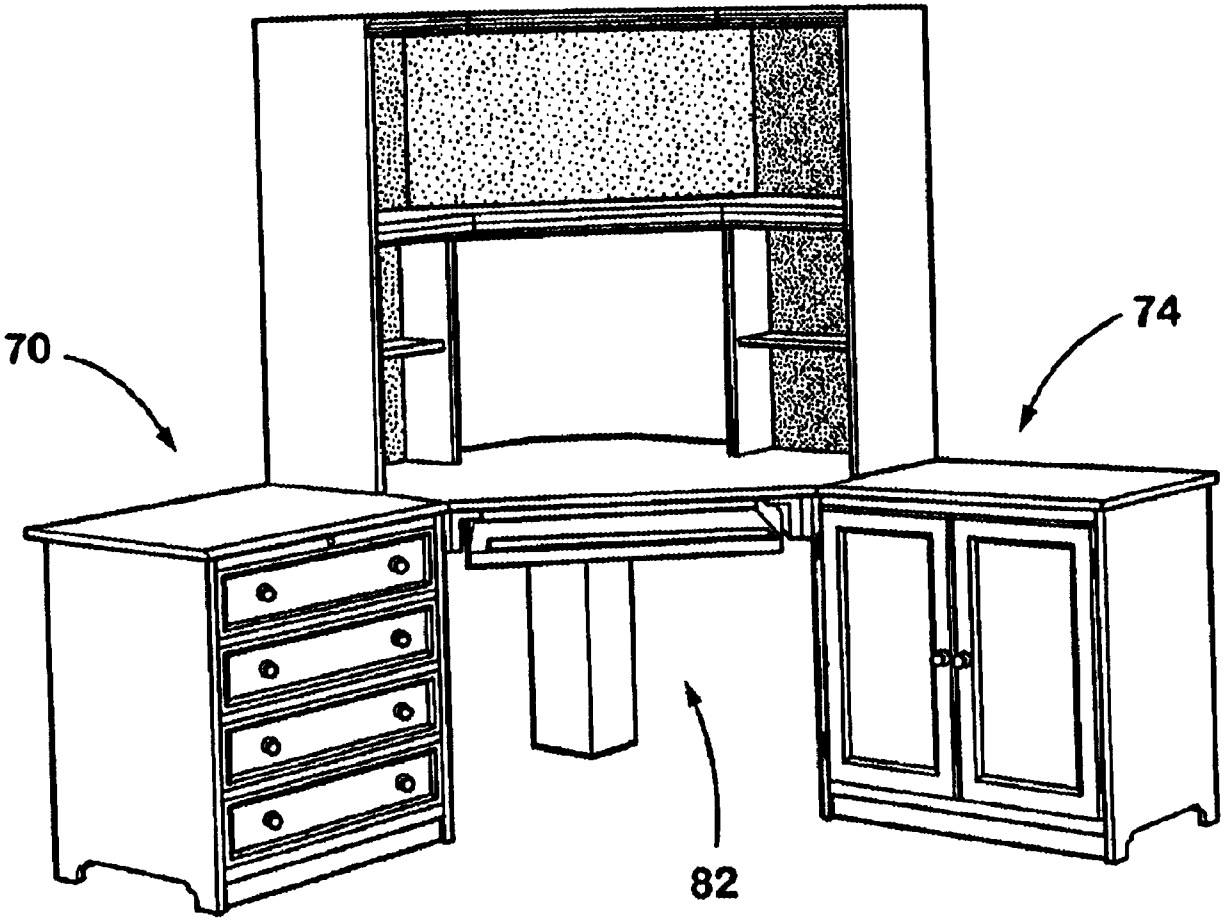
FIG. 3 is a front perspective view of a third arrangement of components of the system.
Figure 4:
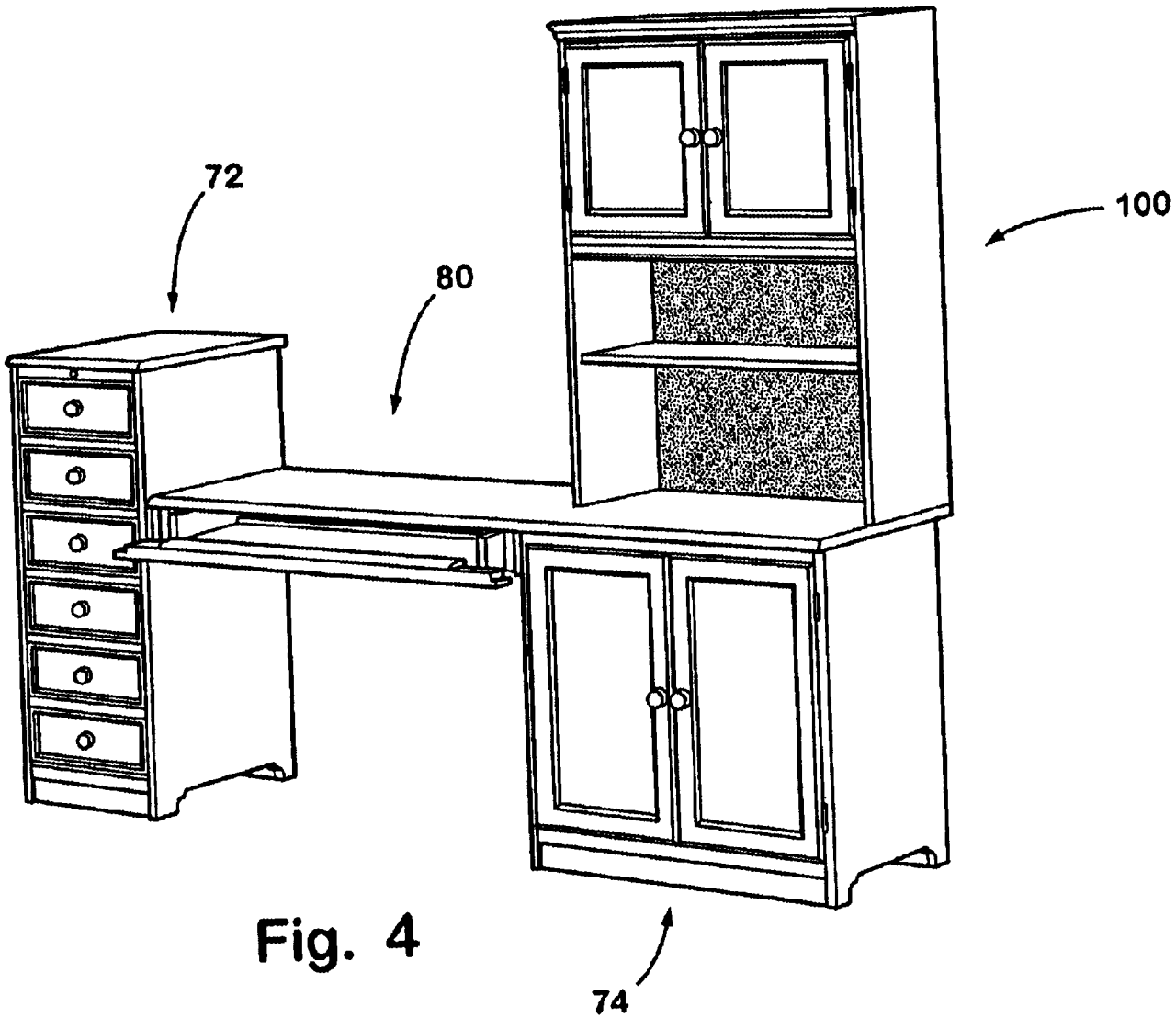
FIG. 4 is a front perspective view of a fourth arrangement of components of the system.
Figure 8:
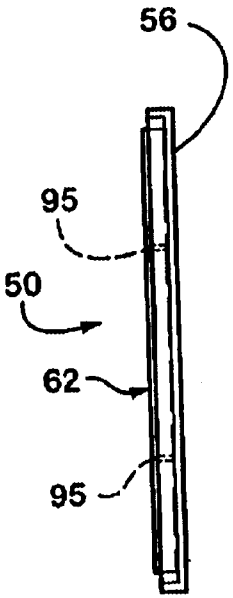
FIG. 8 is a top plan view thereof.
Figure 7:
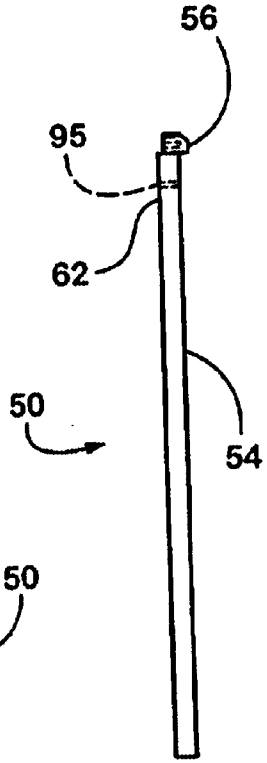
FIG. 7 is an egde elevational view thereof.
Figure 6:
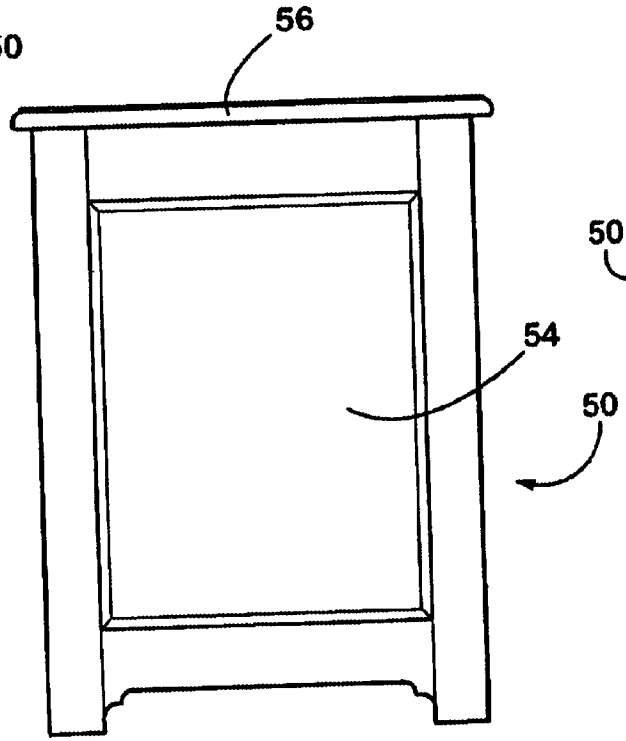
FIG. 6 is a back elevational view of thereof.
Figure 5:
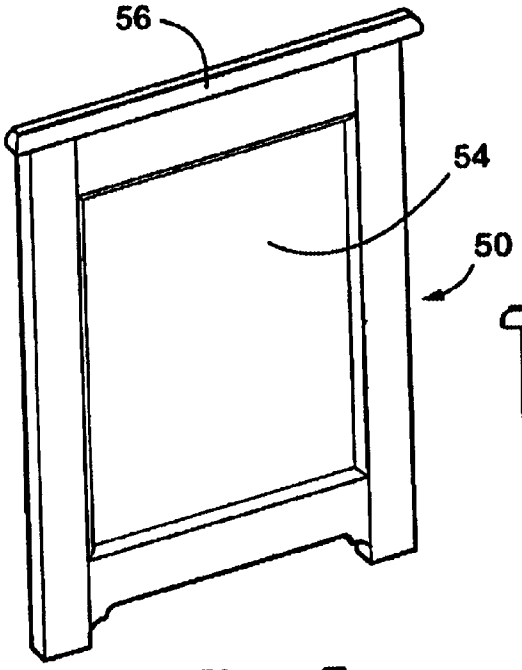
FIG. 5 is a front perspective view of an exterior end panel of the system.
Figure 12:
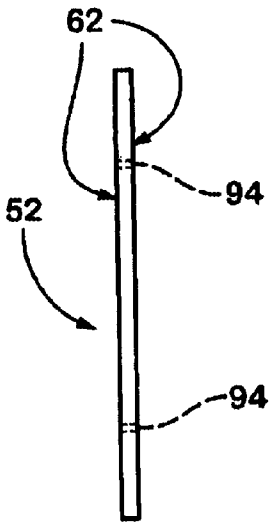
FIG. 12 is a top plan view thereof.
Figure 11:
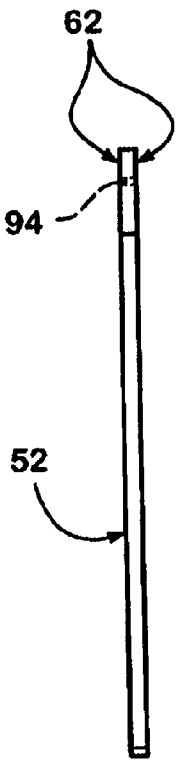
FIG. 11 is a front edge elevational view thereof.
Figure 10:
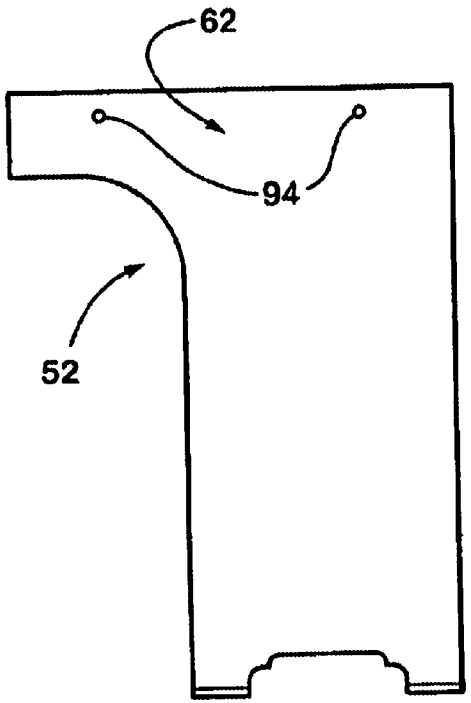
FIG. 10 is a side elevational view thereof.
Figure 9:
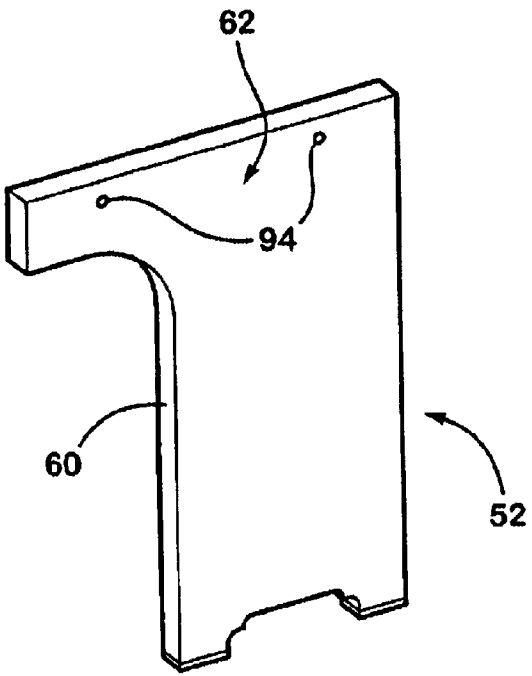
FIG. 9 is a front perspective view of an interior end panel of the system.
Figure 14:
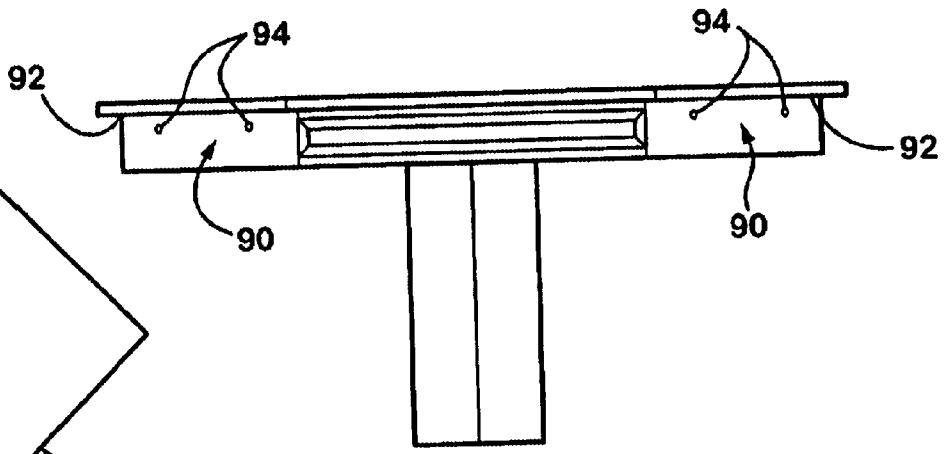
FIG. 14 is a front elevational view thereof.
Figure 13:
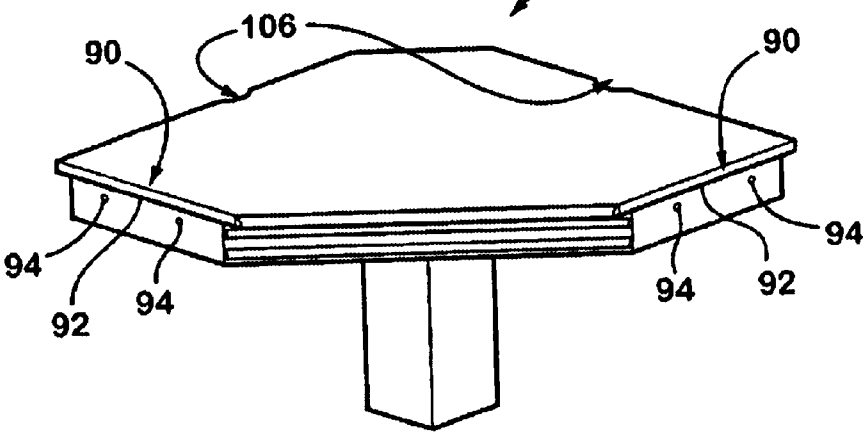
FIG. 13 is a front perspective view of a corner desk unit of the system.
Figure 15:
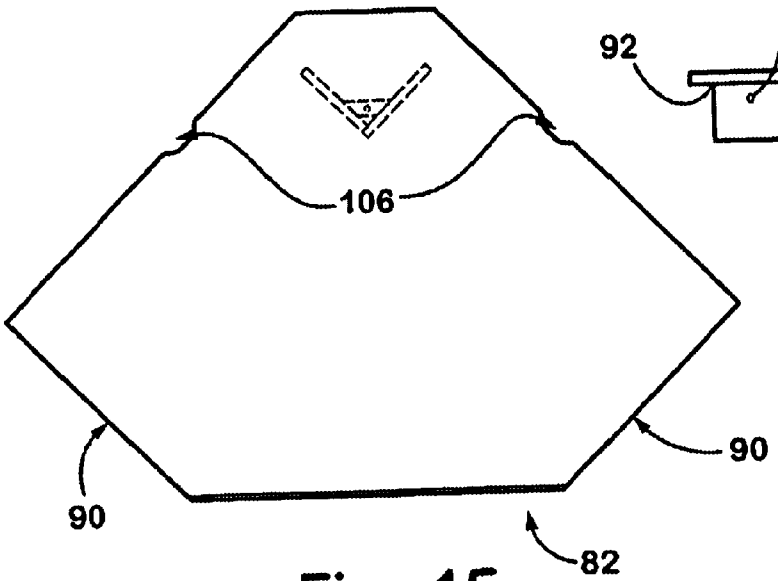
FIG. 15 is a top plan view thereof.
Figure 16:
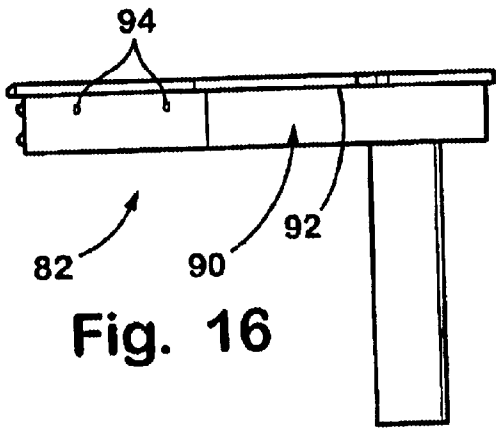
FIG. 16 is a side elevational view thereof.
Figure 18:
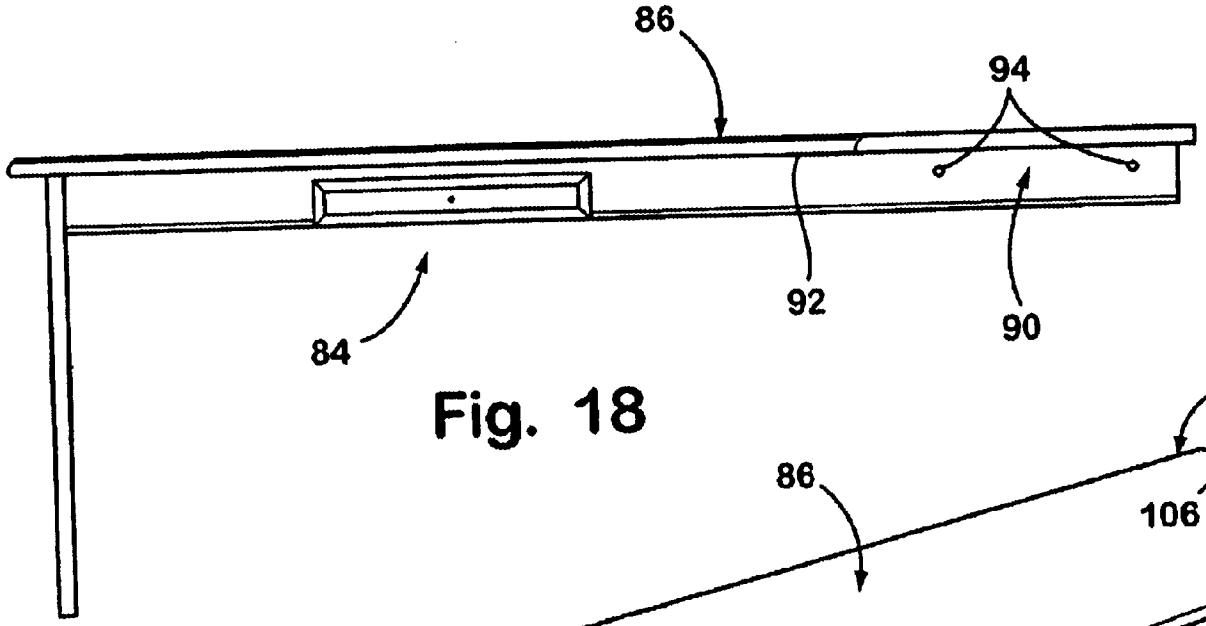
FIG. 18 is a side elevational view thereof.
Figure 17:
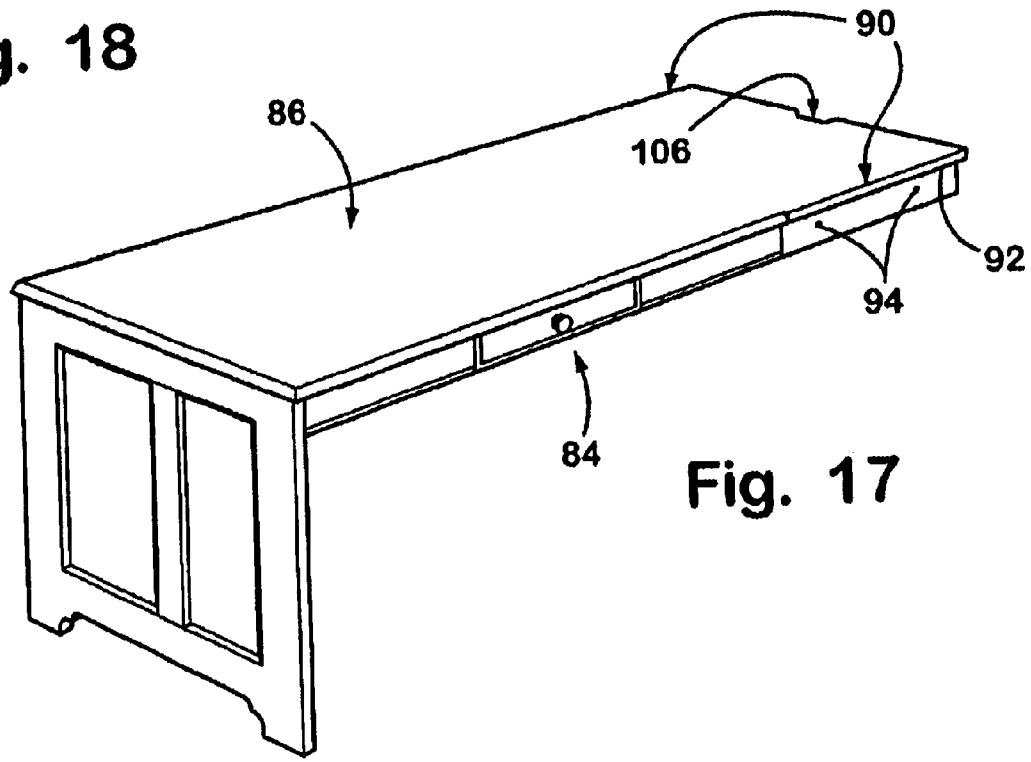
FIG. 17 is a front perspective view of a peninsula desk unit of the system.
Figure 19:
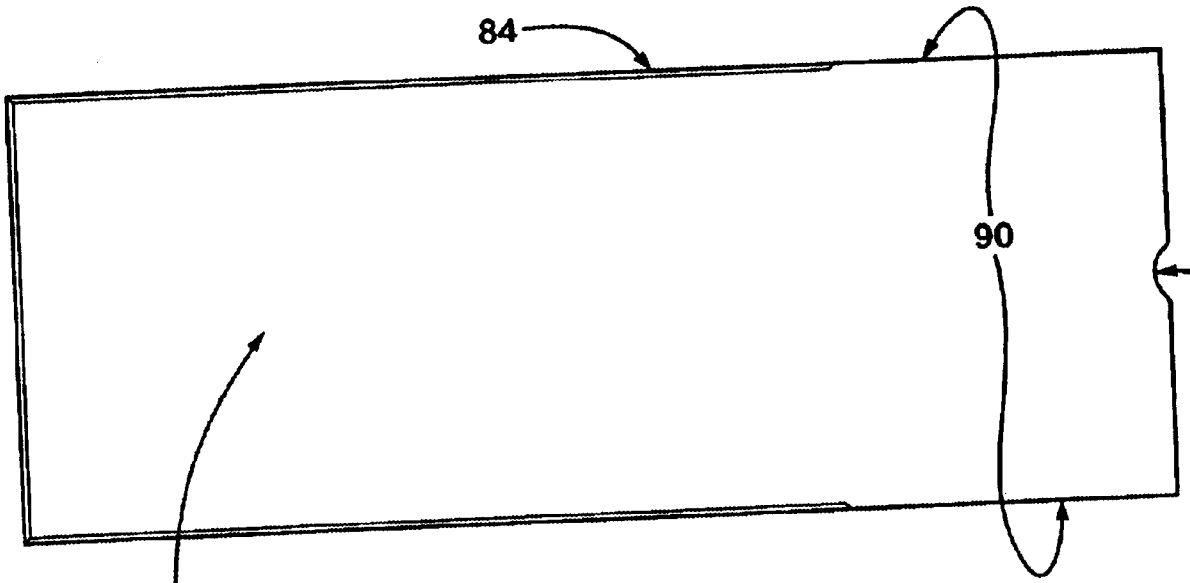
FIG. 19 is a top plan view thereof.
Figure 20:
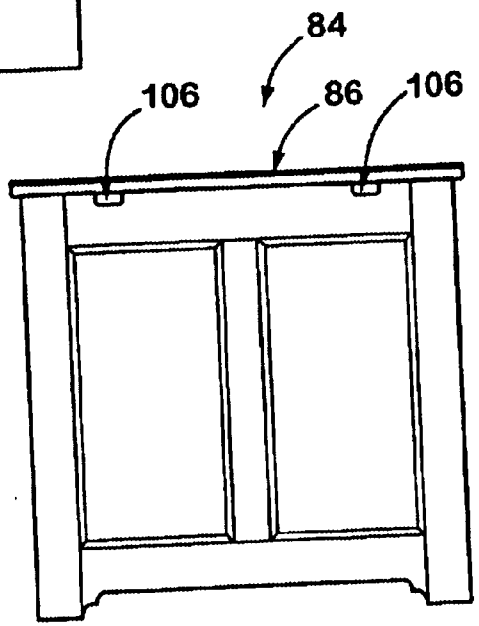
FIG. 20 is an end elevational view thereof.
Figure 23:
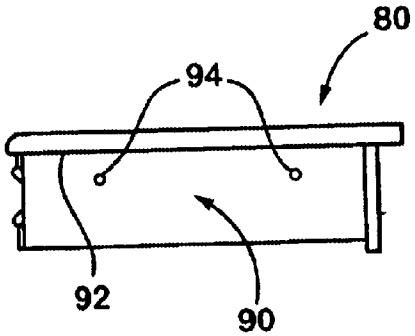
FIG. 23 is an end elevational view thereof.
Figure 21:
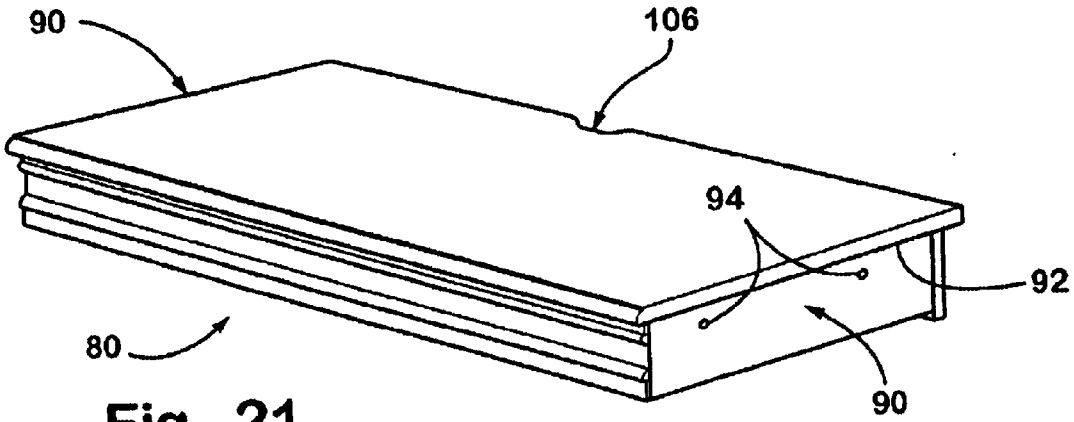
FIG. 21 is a front perspective view of a straight work surface unit of the system.
Figure 22:
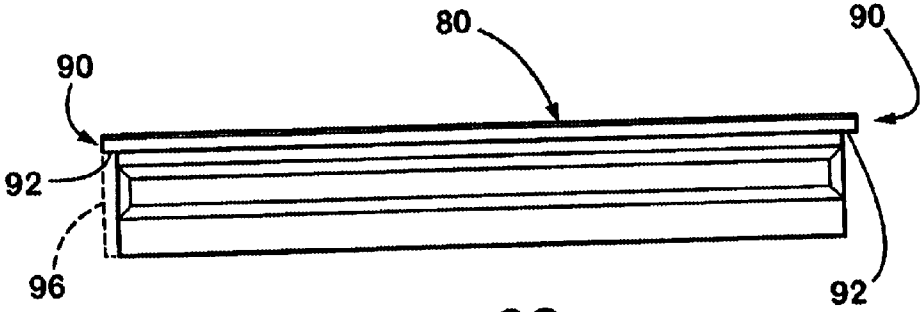
FIG. 22 is a front elevational view thereof.
Figure 24:
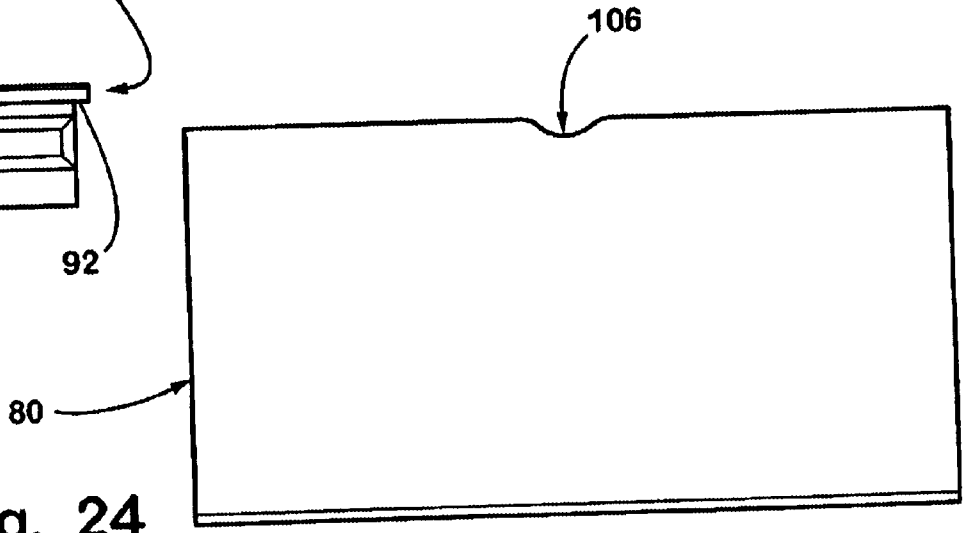
FIG. 24 is a top plan view thereof.
Figure 27:
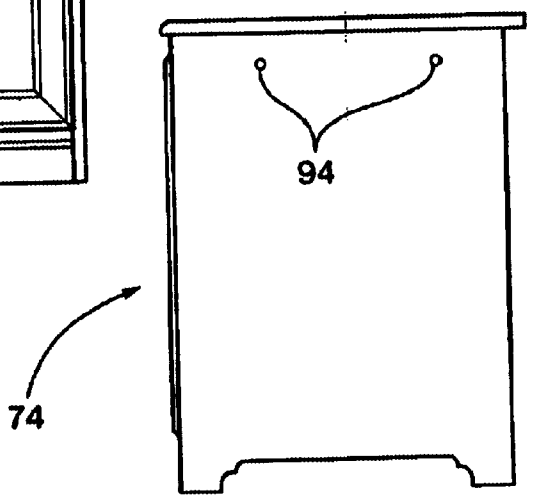
FIG. 27 is a side elevational view thereof.
Figure 26:
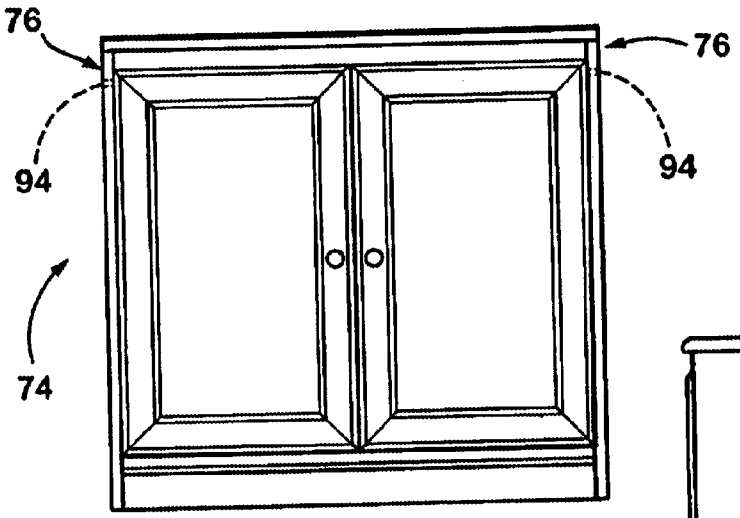
FIG. 26 is a front elevational view thereof.
Figure 28:
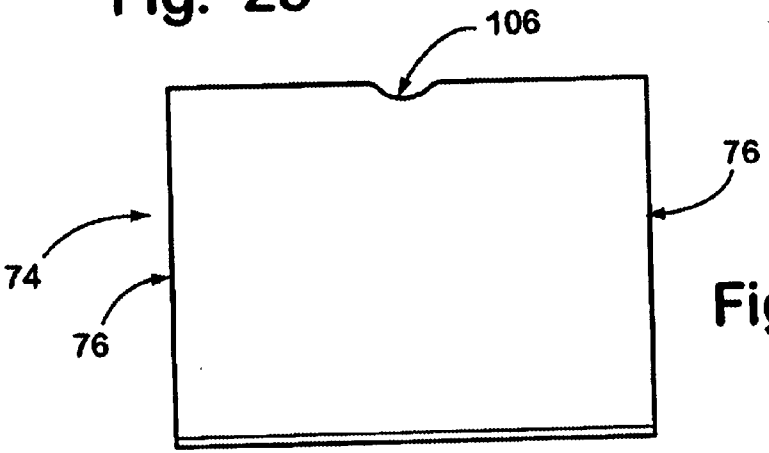
FIG. 28 is a top plan view thereof.
Figure 25:
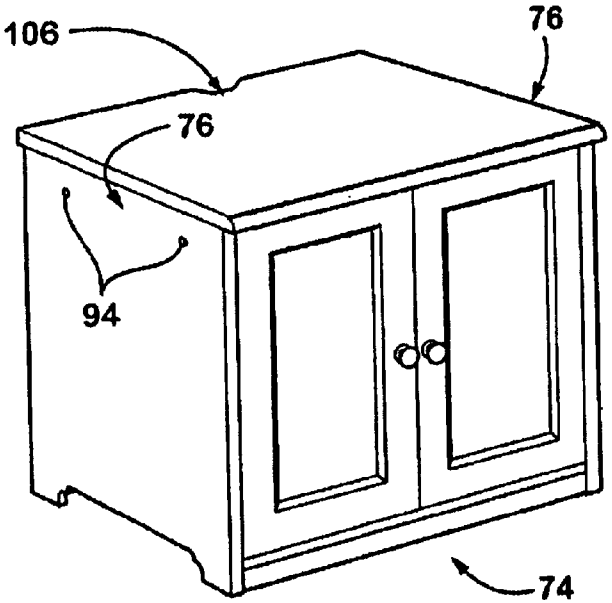
FIG. 25 is a front perspective view of a door cabinet unit of the system.
Figure 30:
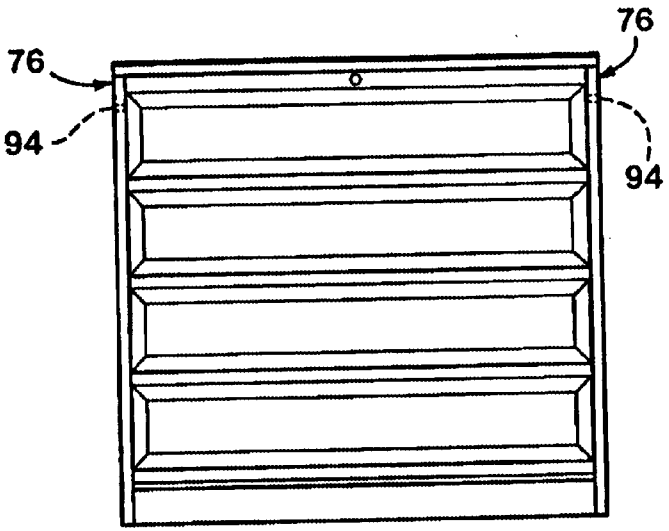
FIG. 30 is a front elevational view thereof.
Figure 29:
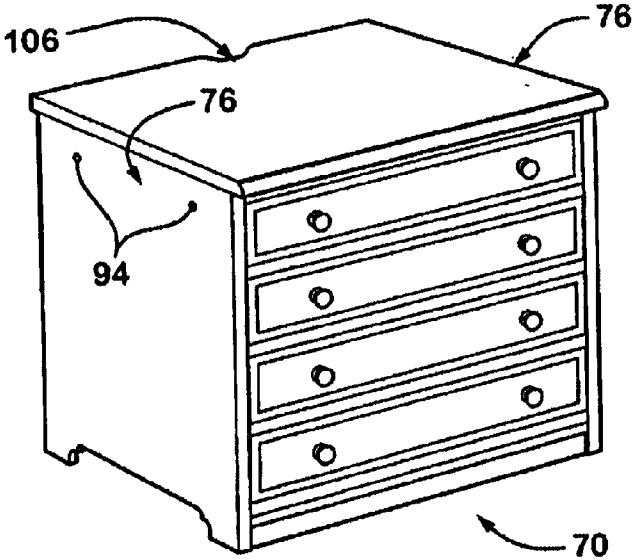
FIG. 29 is a front perspective view of a lateral file unit of the system.
Figure 32:
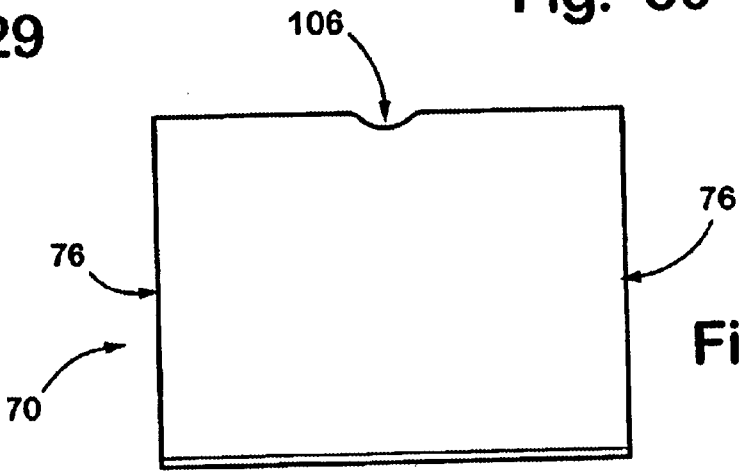
FIG. 32 is a top plan view thereof.
Figure 31:
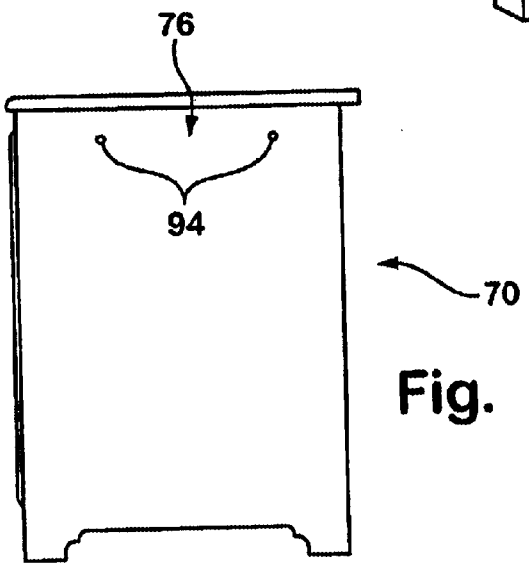
FIG. 31 is a side elevational view thereof.
Figure 36:
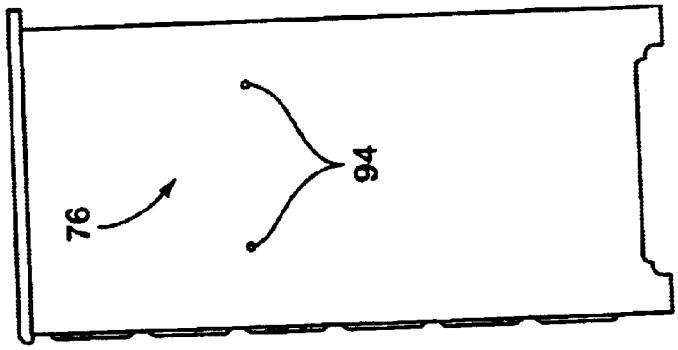
FIG. 36 is a side elevational view thereof.
Figure 35:
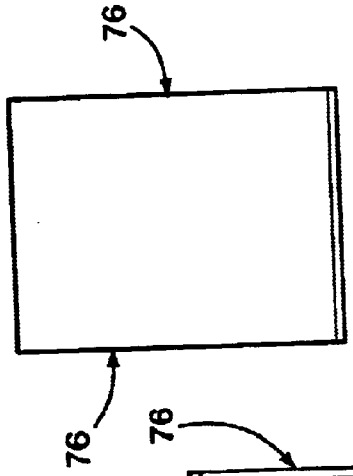
FIG. 35 is a top plan view thereof.
Figure 34:
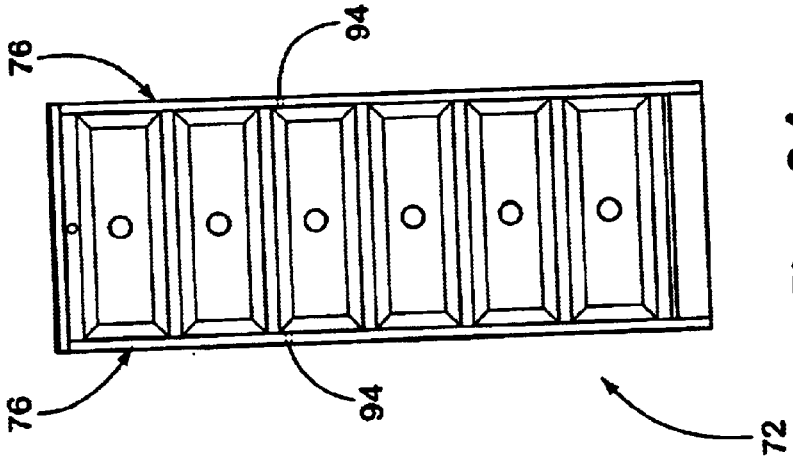
FIG. 34 is a front elevational view thereof.
Figure 33:
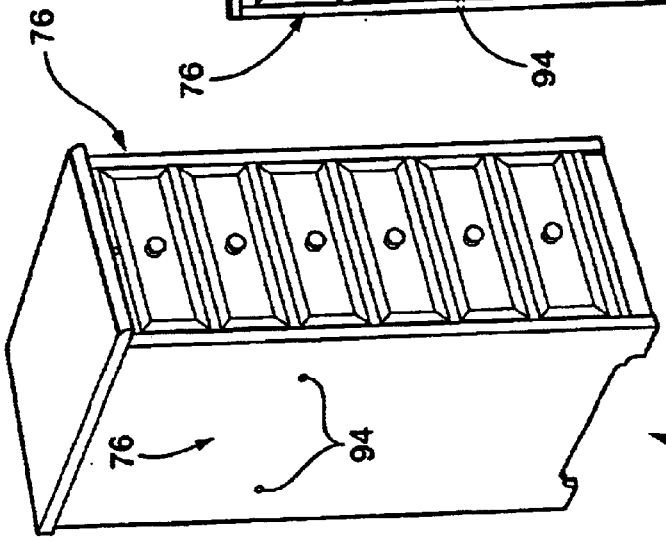
FIG. 33 is a front perspective view of a vertical file unit of the system.
Figure 39:
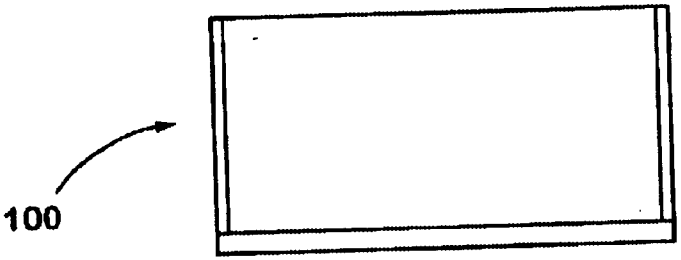
FIG. 39 is a top plan view thereof.
Figure 40:
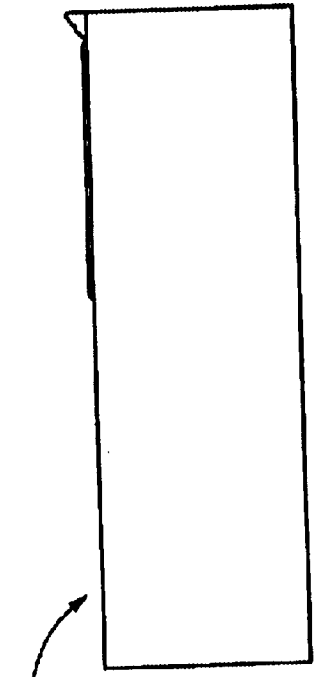
FIG. 40 is a side elevational view thereof.
Figure 38:
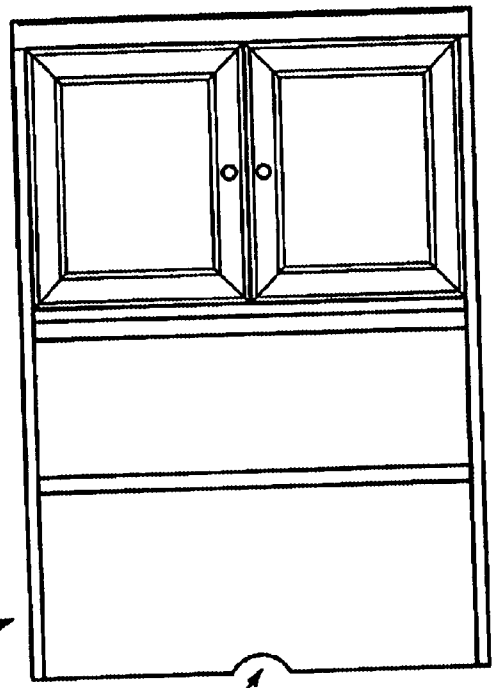
FIG. 38 is a front elevational view thereof.
Figure 37:
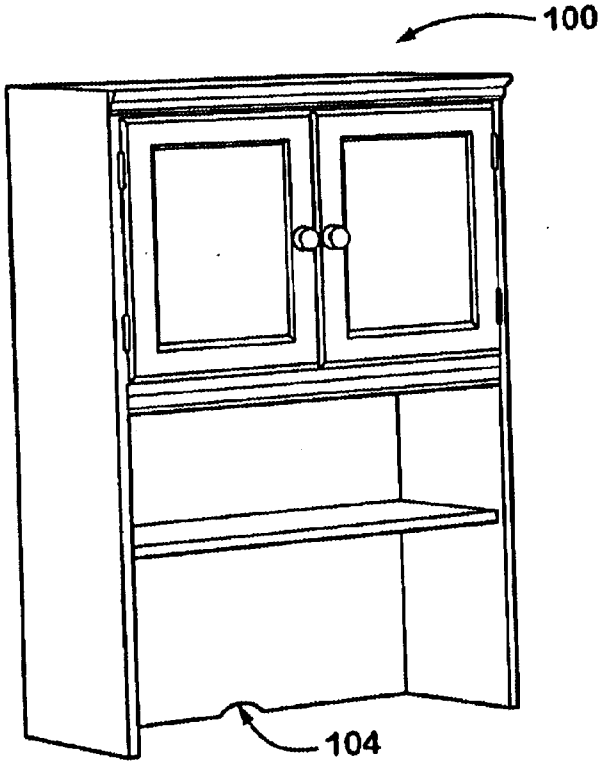
FIG. 37 is a front perspective view of a deck unit of the system.
Figure 42:
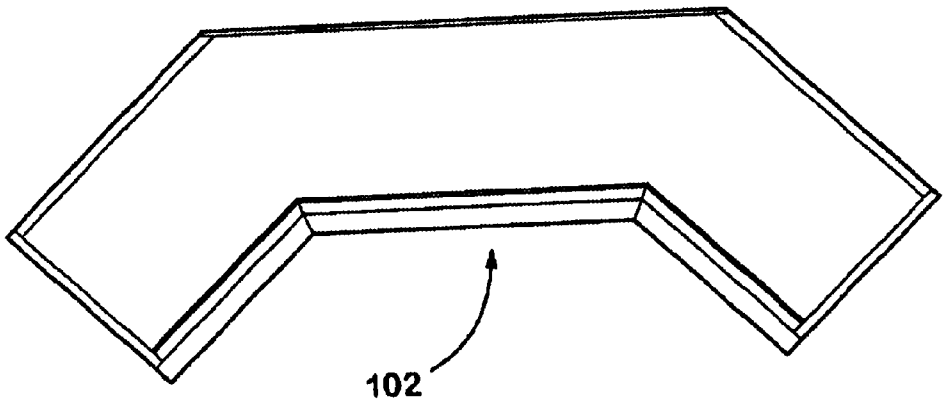
FIG. 42 is a top plan view thereof.
Figure 41:
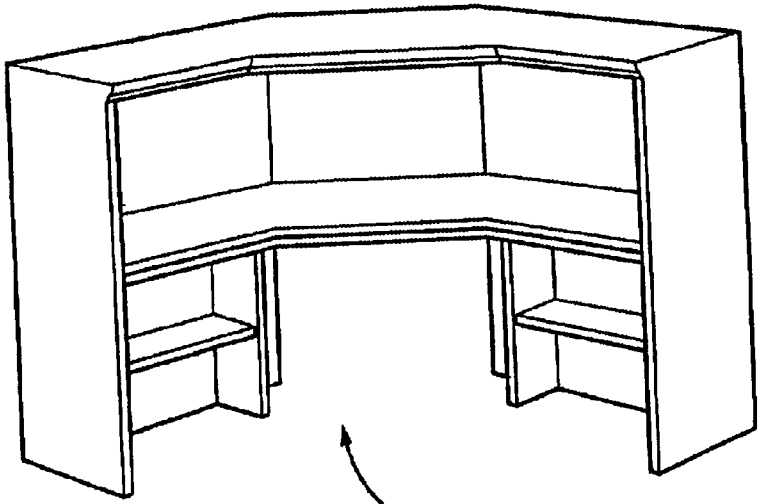
FIG. 41 is a front perspective view of a corner deck unit of the system.
Figure 43:
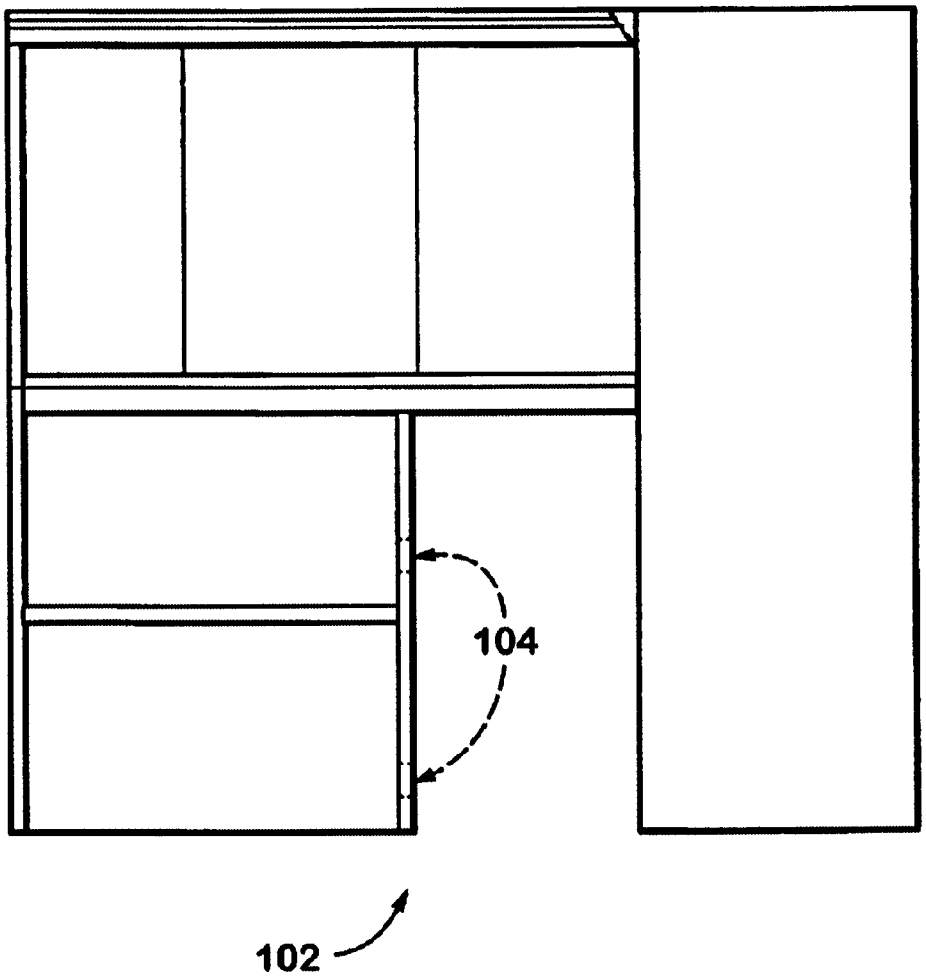
FIG. 43 is a right end elevational view thereof.

A modular furniture system and its components are generally shown in the drawing figures. A first configuration of a work station, using the modular furniture system of the invention, is shown in drawing FIG. 1. A second configuration of a work station is shown in drawing FIG. 2. A third configuration of a work station is shown in drawing FIG. 3. And, a fourth configuration of a work station is shown in drawing FIG. 4.

The modular furniture system comprises a number of variously configured support members, a number of variously configured work surfaces or desks, a number of couplers to releasably couple support members with work surfaces, and a number of variously configured hutch or desk top units.

The support members may take various forms, including, but not limited to, a support leg or a storage cabinet, which are specifically shown in the drawing figures. The support members are floor standing members that releasably couple with a work surface to support the work surface above a floor, as is discussed in greater detail below. Also, the support members may be fabricated of any suitable structural material, including wood, plastic, and metal, for example, as will be understood by one having ordinary skill in the art. As will also be appreciated by one having ordinary skill in the art, the alignment, leveling, and interconnection of various floor standing components in combination with commonly uneven floors, may lead one to experience some difficulties and frustration. Thus, each of the support members is provided with height adjustable legs or leg leveling feet, as are commonly available and well known in the trade.

As is generally shown in the drawing figures, the leg support members may be configured as decorative end panels 50 (FIGS. 5–8) and interior panels 52 (FIGS. 9–12). The end panel 50 may be constructed with a decorative exterior side 54 and a finish molding 56 at a top of the end panel 50, to finish an edge of a mating work surface. The interior panel 52 is preferably cut back along a front edge 60 to enhance obstruction free leg movement by a user, where an interior panel is releasably coupled between two work surfaces. In either configuration, the support member has a generally vertical coupling surface 62 to abut an end of a work surface, so the support member and work surface may be releasably coupled, as discussed in greater detail below. Further, because of the decorative nature of the end panels 50, the end panels 50 may be distinguished from the other support members by use of a threaded insert 95 that is seated in a blind hole that is provided in the coupling surface 62, rather than by use of the coupling apertures 94, as will be understood by one having ordinary skill in the art, and as is discussed in greater detail below.

The support members may also be configured as storage cabinets, including drawer and shelf storage. Specific examples of storage cabinet support members are shown in the drawing figures as a lateral file unit 70 (FIGS. 29–32), a vertical file unit 72 (FIGS. 33–36), and a door cabinet unit 74 (FIGS. 25–28). Each of the storage cabinet support members may have generally conventional construction, as will be understood by one having ordinary skill in the art, but is also provided with a generally vertical side surface to abut and releasably couple with an end of a work surface.

Each of the work surfaces is preferably configured with at least three sides and may include the generally rectangular work surface 80 (FIGS. 21–24) and hexagonal corner desk 82 (FIGS. 13–16) that are specifically shown in the drawings, for example. Further, a peninsula desk 84 (FIGS. 17–20) may be configured with a work surface 86 and decorative end panel 50. One having ordinary skill in the art will understand that a work surface may be constructed with various configurations, including and in addition to those shown in the drawing figures and discussed. Further, the desks may be provided with keyboard trays and drawers and the like to enhance its utility.

At least two of the at least three sides of a work surface will be constructed as ends 90 to provide releasable coupling of the work surface with other components of the furniture system. That is to say that the end of a work surface is a side portion of the work surface, that is adapted to mate and releasably couple with a support member. As specifically shown in the drawing figures, an end 90 is adapted by providing a generally vertical surface with a pair of assembly apertures 94 to cooperate with the coupler 110, as is explained further below.

The end 90 of a work surface is not necessarily located at what one might conventionally consider an end edge of the work surface, however. While the rectangular work surface 80 does have two opposing ends 90 that are located at what one might conventionally consider the opposing end edges of the work surface, the corner work surface 82 has two ends 90 that are oriented generally perpendicular to, not opposite, one another, for example.

Each end 90 also includes an overhang 92. The depth of the overhang 92 corresponds to about one half the thickness of a leg support member 50 or 52, so the overhang 90 will rest upon the top of the leg support member. When an end panel 50 is used, the overhang 90 will overlay about half of the thickness of the end panel and abut the finish molding 56 to present a finished, assembled appearance. When two work surfaces are arranged adjacent one another, an interior panel 52 is used to support the work surfaces, and the overhangs 92 of each work surface or desk will overlay about half of the interior panel 52 to abut with one another. And, when a work surface is releasably coupled with a storage cabinet support member, a spacer 96 (shown in phantom in FIG. 22) that is about half the thickness of a leg support member, is used to fill the overhang 92 and present a flush face to mate with the storage cabinet.

Upper level storage, lighting, and wire management may be provided by hutches or desk top units that correspond to the various work surfaces or desks. For example, the desk top 100 (FIGS. 37–40) cooperates with the work surface 80 and the cabinet support members 70, 72, and 74 by having a footprint that corresponds to the configuration of the work surface 80 and the cabinet support members 70, 72, and 74. Likewise, the corner desk hutch 102 cooperates with the corner desk work surface 82 by being configured with a footprint that corresponds to the corner desk 82. The hutches may also have conventional construction, as will be understood by one having ordinary skill in the art, but will preferably include cabling passages 104, and the like to facilitate installation and use of electronic equipment in the work station. Further, the cabinet support members 70, 72, and 74, and the work surfaces 80 and 82 also preferably include cabling passages 106, and the like to facilitate installation and use of electronic equipment in the work station.

In use, any combination of work surfaces and support members may be arranged and interconnected to provide the productivity requirements and needs of a given work station without the imposition of mandating the use of office partition panels. With reference to the arrangement of drawing FIG. 4, for example, a work surface unit 80 is positioned adjacent to and releasably coupled with a vertical file unit 72 at one end of the work surface, and a door cabinet 74 at an opposing end of the work surface. Further, a desk hutch 100 is positioned atop the door cabinet unit 74 for additional upper level storage and access.

Figure 45:
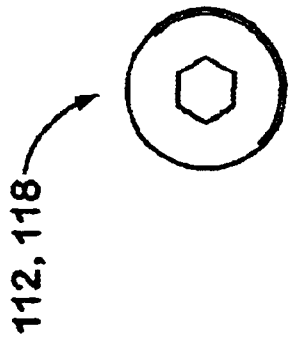
Fig. 45 (Prior Art)
FIG. 45 is an end elevational view thereof, both ends are noted to appear the same in elevation.
Figure 44:
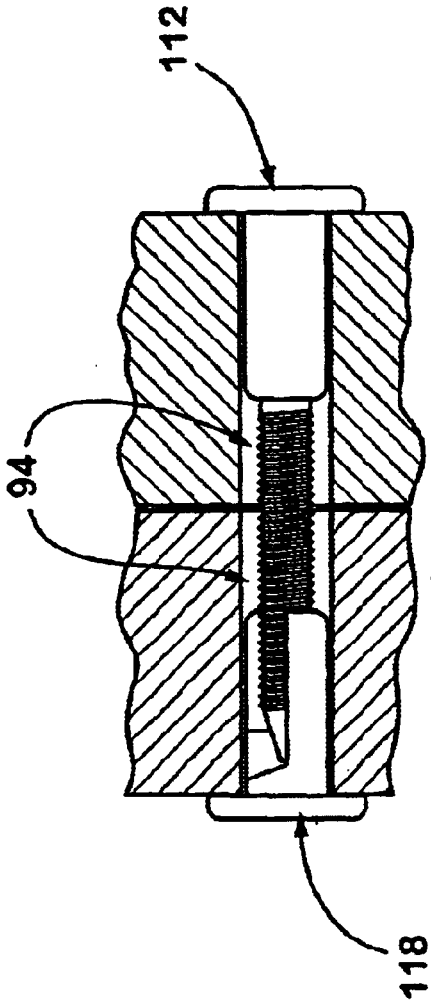
Fig. 44 (Prior Art)
FIG. 44 is a fragmentary centerline cross-sectional view showing a known coupler.
Figure 46:
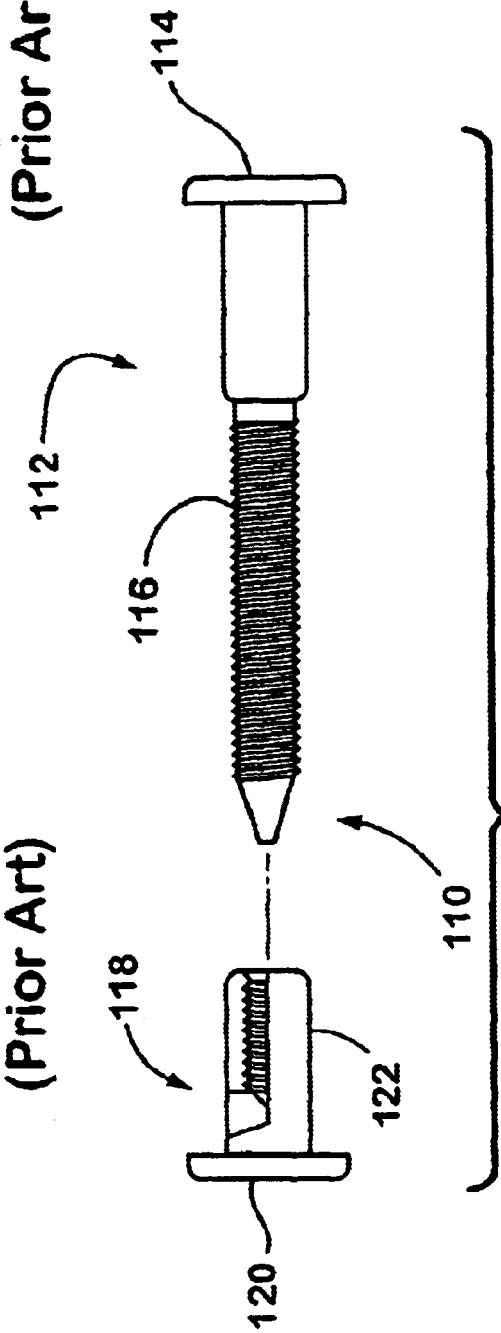
Fig. 46 (Prior Art)
FIG. 46 is an exploded, side elevational view there.

The various modular furniture system components may be interconnected with commonly available couplers 110 as shown in drawing FIGS. 44–46. Each coupler 110 has a body 112, with a head 114 and a threaded leg 116 that extends away from the head to a terminal end, and has a cooperating nut 118, with a head 120 and a threaded shaft 122 that extends away from the head to a terminal end. To use the coupler 110, each of the support members and the work surfaces are provided with pairs of assembly apertures 94 that are positioned for mutual alignment when the components of the modular furniture system are arranged to form a work station. With the assembly apertures 94 aligned, the coupler body 112 is inserted to extend into an assembly aperture 94 and the nut 118 is inserted into the opposing end of an aligned assembly aperture 94 to meet the terminal end of the leg 116. The leg 116 and the nut 118 are provided with cooperating screw threading, so the nut 118 and body 112 couple with one another in screwing engagement as will be understood by one having ordinary skill in the art. As the body 112 and nut 118 are screwed together, the respective support member and work surface are drawn tightly together to secure the arrangement of components. As discussed above, the decorative end panels 50 are provided with threaded inserts 95 that are seated in blind holes, as will be understood by one having ordinary skill in the art. Thus, assembly of a work surface with an end panel 50 will include threading engagement of the leg 116 with the insert 95, rather than with the nut 118.

Depending upon the specific arrangement of components to make up a work station, a coupler 110 may be required to extend through at least two thicknesses as shown in drawing FIG. 44, or a coupler 110 may be required to extend through three thicknesses of material. For example, while the use of a leg support member at an end of a work surface will require a coupler 110 to extend through two thicknesses of material, positioning a two work surfaces adjacent one another will require use of an interior leg support member between the work surfaces, and require the coupler 110 to releasably couple the three components together.

It will be understood by one having ordinary skill in the art and by those who practice the invention, that various modifications and improvements may be made without departing from the spirit of the disclosed concept. The scope of protection afforded is to be determined by the claims and by the breadth of interpretation allowed by law.

We claim:

1. A modular furniture system comprising a plurality of individual furniture elements that are releasably connected together to form an integral furniture assembly, the furniture elements comprising at least one generally horizontal work surface having ends, a front and a back, the system further comprising other furniture elements that are attachable to the ends of the work surface to support the work surface at a desired working elevation above a supporting floor surface, each end of the work surface being supported on one of a free standing cabinet and a floor engaging support panel, the support panel having a predetermined panel thickness, the work surface having a top panel that extends to an outer edge at each end of the work surface, the work surface having a downwardly extending mounting flange on an underside of the work surface adjacent each end, the mounting flange being positioned parallel to the outer edge of the top panel and spaced inwardly therefrom, such that when the support panel is fitted under the top panel and against the mounting flange, the outer edge of the top panel extends over a top edge of the support panel, the support panel being attached to the work surface by releasable fasteners that extend through mating openings in the mounting flange and support panel, the free standing cabinet that is attached to the work surface having a flat end panel, with a top that extends over the end panel to a side edge that is generally flush with an outer surface of the end panel, the cabinet being attachable to the work surface by bolts that extend through mating openings in the cabinet end panel and the mounting flange on the underside of the work surface, with a spacer filling the space between the work surface mounting flange and the end panel of an adjacent cabinet.

* * * * *